US009376838B2

(12) United States Patent
Ino et al.

(10) Patent No.: US 9,376,838 B2
(45) Date of Patent: Jun. 28, 2016

(54) CYLINDER LOCK

(71) Applicant: KABUSHIKI KAISHA HONDA LOCK, Miyazaki-Shi, Miyazaki (JP)

(72) Inventors: Shinichirou Ino, Miyazaki (JP); Takashi Ishitsuka, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 0 days.

(21) Appl. No.: 14/775,754

(22) PCT Filed: Jan. 23, 2014

(86) PCT No.: PCT/JP2014/051341

§ 371 (c)(1),
(2) Date: Sep. 14, 2015

(87) PCT Pub. No.: WO2014/141749

PCT Pub. Date: Sep. 18, 2014

(65) Prior Publication Data

US 2016/0024815 A1 Jan. 28, 2016

(30) Foreign Application Priority Data

Mar. 14, 2013 (JP) ..... 2013-051913

(51) Int. Cl.
*E05B 27/00* (2006.01)
*E05B 29/00* (2006.01)
(Continued)

(52) U.S. Cl.
CPC ..... *E05B 27/001* (2013.01); *E05B 17/041* (2013.01); *E05B 17/045* (2013.01); *E05B 27/0021* (2013.01); *E05B 27/02* (2013.01); *E05B 29/00* (2013.01)

(58) Field of Classification Search
CPC ..... E05B 17/04; E05B 29/00; E05B 29/02; E05B 29/04; E05B 31/00; E05B 47/0649; E05B 17/041; E05B 17/047; E05B 9/10; E05B 2047/0026; E05B 17/045; E05B 27/01; E05B 27/02; E05B 27/0021; Y10T 70/7599; Y10T 70/7706; Y10T 70/7588; Y10T 70/765; Y10T 70/7864; Y10T 70/7949; Y10T 70/5889; Y10T 70/7712
USPC ..... 70/379 R, 380
See application file for complete search history.

(56) References Cited

U.S. PATENT DOCUMENTS 5,570,599 A * 11/1996 Konii ..... B60R 25/02126 70/186
6,003,349 A * 12/1999 Nagae ..... B60R 25/02115 70/186

(Continued)

FOREIGN PATENT DOCUMENTS

JP S61-185872 U 11/1986
JP H08-312210 A 11/1996

(Continued)

*Primary Examiner* — Suzanne Barrett
(74) *Attorney, Agent, or Firm* — Carrier Blackman & Associates, P.C.; Joseph P. Carrier; Anne G. Sabourin

(57) ABSTRACT

In a cylinder lock having a pivot member pivoted in response to pivoting by a legitimate mechanical key inserted into a key hole, a first rotor is linked to an outer cylinder relatively non-pivotably but movably along an insertion direction of a mechanical key, and a second rotor abuts against the first rotor from a side opposite to a rotor-receiving part provided on a housing and the outer cylinder and is linked to a pivot member relatively non-pivotably but movably along the insertion direction, and during pivoting of the outer cylinder in response to an unauthorized pivoting operation of an inner cylinder, the first rotor and the second rotor move so as to detach from the rotor-receiving part due to a cam mechanism provided between the first rotor and the housing, thereby releasing engagement of the inner cylinder with the second rotor linked to the pivot member relatively non-pivotably.

1 Claim, 9 Drawing Sheets

(51) Int. Cl.
*E05B 17/04* (2006.01)
*E05B 27/02* (2006.01)

(56) References Cited

U.S. PATENT DOCUMENTS 6,941,779 B2 * 9/2005 Shigeyama ..... B60R 25/02126 70/186
8,156,775 B2 * 4/2012 Yamaguchi ..... E05B 29/0006 70/357
2006/0000248 A1 * 1/2006 Yuhi ..... E05B 17/04 70/360
2006/0156771 A1 * 7/2006 Hauri ..... E05B 47/0649 70/278.7
2007/0209412 A1 * 9/2007 Shiramizu ..... E05B 17/0058 70/276
2008/0168814 A1 * 7/2008 Makino ..... E05B 17/04 70/490
2008/0245119 A1 * 10/2008 Katagiri ..... E05B 17/04 70/360
2009/0031772 A1 * 2/2009 Yamaguchi ..... E05B 85/16 70/453
2009/0038351 A1 * 2/2009 Tamezane ..... E05B 29/00 70/182
2009/0107194 A1 * 4/2009 Tamezane ..... E05B 17/04 70/379 R
2013/0283869 A1 * 10/2013 Yano ..... B65H 5/00 70/490
2015/0075237 A1 * 3/2015 Sasaki ..... E05B 29/00 70/358

FOREIGN PATENT DOCUMENTS

JP 2881103 B2 4/1999
JP 2005-299310 A 10/2005
JP 2006-299722 A 11/2006
JP 2009-002019 A 1/2009

* cited by examiner

CYLINDER LOCK

TECHNICAL FIELD

The present invention relates to a cylinder lock in which a pivot member is pivoted in response to pivoting by a legitimate mechanical key inserted into a key hole and, in particular, relates to a cylinder lock having theft resistance so that the pivot member is not pivoted even by forcibly carrying out pivoting using anything other than a legitimate mechanical key.

BACKGROUND ART

A cylinder lock in which, when anything other than a legitimate mechanical key is inserted into the cylinder lock and forcibly pivoted, a pair of movable bars axially movably disposed on the outer periphery of an outer cylinder are moved to thus release a link between an inner cylinder and a lock lever linked to a lock device is already known from Patent Document 1.

RELATED ART DOCUMENTS

Patent Documents

Patent Document 1: Japanese Patent No. 2881103

DISCLOSURE OF THE INVENTION

Problems to be Solved by the Invention

In the arrangement disclosed in Patent Document 1 above, it is necessary to provide on the outer periphery of the outer cylinder a guide groove into which the movable bar is fitted, the structure becomes complicated, and the thickness of the outer cylinder needs to be increased in terms of strength, resulting in an increase in the radial dimension of the outer cylinder.

The present invention has been accomplished in light of such circumstances, and it is an object thereof to provide a cylinder lock that can give theft resistance with a simple and small-sized structure.

Means for Solving the Problems

In order to attain the above object, according to a first aspect of the present invention, there is provided a cylinder lock in which a pivot member is pivoted in response to pivoting by a legitimate mechanical key inserted into a key hole, characterized in that the cylinder lock comprises an inner cylinder that has the key hole, an outer cylinder that has the inner cylinder relatively pivotably inserted therethrough and retained and that is pivotably retained on a fixed housing, a plurality of tumblers that are retained on the inner cylinder so as to be capable of switching between a state in which the tumblers engage with the outer cylinder and a state in which engagement with the outer cylinder is released in response to the legitimate mechanical key being inserted into the key hole, a first rotor that is disposed so as to oppose a rotor-receiving part provided on one of the housing and the outer cylinder so as to face forward along an insertion direction of the mechanical key into the key hole and that is linked to the outer cylinder relatively non-pivotably but movably along the insertion direction, a second rotor that abuts against the first rotor from a side opposite to the rotor-receiving part and that is linked to the pivot member relatively non-pivotably but movably along the insertion direction, a resilient member that exhibits a resilient force for urging the first and second rotors, abutting against each other, toward the rotor-receiving part side, and a cam mechanism that is provided between the housing and the first rotor so as to move the first rotor against the resilient force of the resilient member, in response to pivoting of the first rotor accompanying pivoting of the outer cylinder, toward a side on which the first rotor becomes detached from the rotor-receiving part, the inner cylinder being provided with an engagement part that relatively non-pivotably engages with the second rotor in a state in which the second rotor abuts against the first rotor, abutting against the rotor-receiving part, from the side opposite to the rotor-receiving part and that releases engagement with the second rotor in a state in which the first and second rotors are detached from the rotor-receiving part due to operation of the cam mechanism.

Further, according to a second aspect of the present invention, in addition to the first aspect, the engagement part relatively non-pivotably engages with the first rotor in a state in which the first rotor is detached from the rotor-receiving part.

EFFECTS OF THE INVENTION

In accordance with the first aspect of the present invention, if anything other than the legitimate mechanical key, such as a screwdriver, is inserted into the key hole of the inner cylinder and an unauthorized pivoting operation is carried out, since the tumbler is engaged, the outer cylinder pivots together with the inner cylinder, and due to the function of the cam mechanism between the first rotor and the housing the first and second rotors move so as to become detached from the rotor-receiving part of one of the housing and the outer cylinder. As a result, engagement of the engagement part of the inner cylinder with the second rotor is released; even if the inner cylinder pivots the second rotor will not pivot, and the pivot member is therefore not pivoted, thereby enabling theft resistance to be obtained. Moreover, a theft resistant cylinder lock can be obtained by a simple and small-sized structure having a smaller number of components, which is a simple structure in which the first rotor is disposed between the second rotor and the outer cylinder and the cam mechanism is provided between the first rotor and the housing.

Furthermore, in accordance with the second aspect of the present invention, since the engagement part of the inner cylinder engages with the first rotor in a state in which it is detached from the rotor-receiving part, even if the inner cylinder is pivoted to a position that is different from a usual position by means of an unauthorized operation and is left there while engagement with the second rotor is released, when the legitimate mechanical key is inserted into the key hole and pivotingly operated, the first rotor also pivots together with the inner cylinder, the first rotor in a state in which it is urged by the resilient member moves to the side on which it abuts against the rotor-receiving part of the outer cylinder by virtue of the operation of the cam mechanism, and the second rotor also moves accompanying it, thereby recovering engagement of the engagement part of the inner cylinder with the second rotor. Therefore, as a result of a pivoting operation of the legitimate mechanical key inserted into the key hole, the second rotor pivots together with the inner cylinder, thus enabling the pivot member to be pivoted.

EXPLANATION OF REFERENCE NUMERALS AND SYMBOLS

Figure 1:
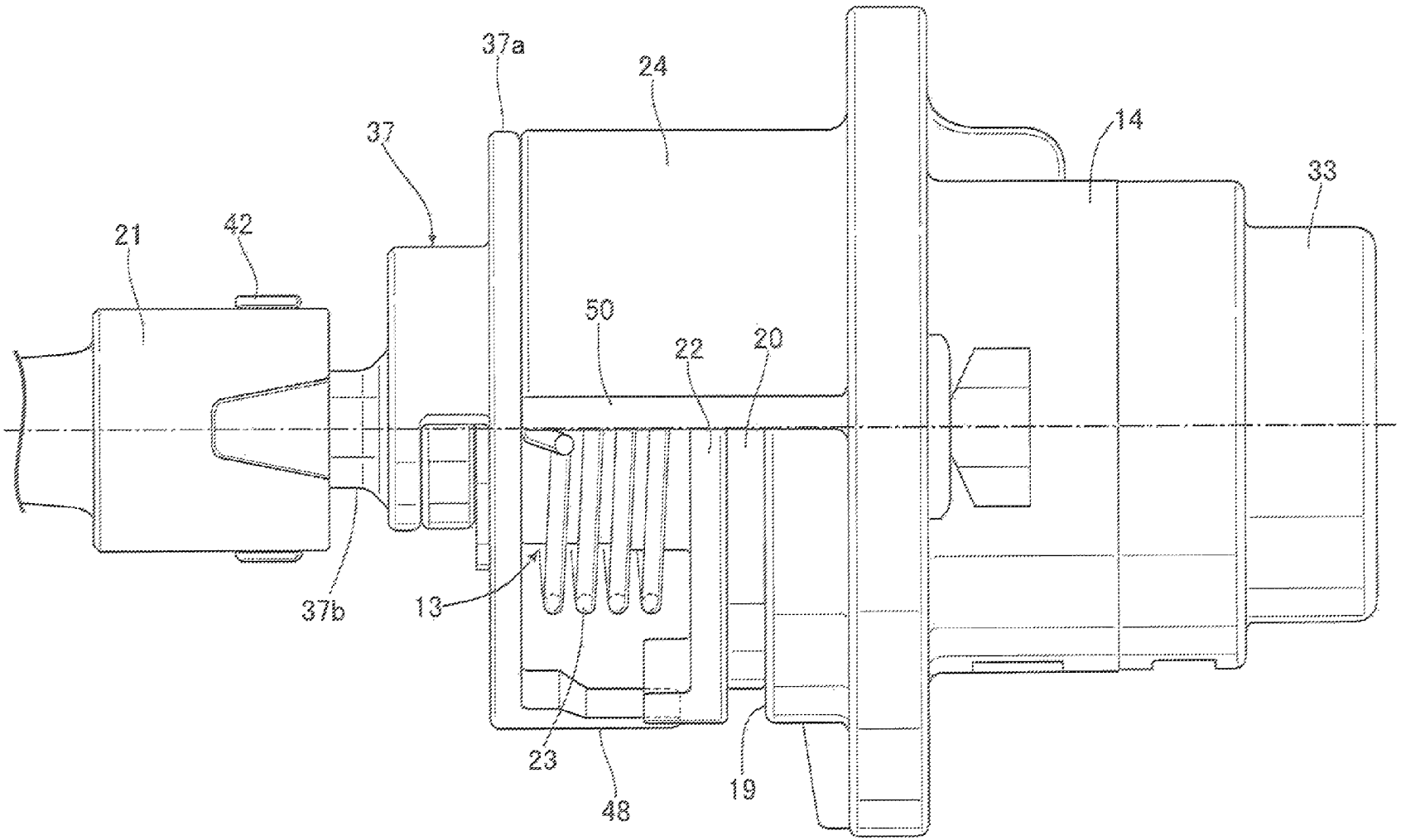
FIG. 1 is a side view of a cylinder lock. (first embodiment)

11 Mechanical key
12 Key hole
13 Inner cylinder
14 Housing
15 Outer cylinder
16, 17 Tumbler
18 Insertion direction
19 Rotor-receiving part
20 First rotor
21 Pivot member
22 Second rotor
23 Torsion spring, which is resilient member
52 Engagement part
55 Cam mechanism

MODES FOR CARRYING OUT THE INVENTION

An embodiment of the present invention is explained below by reference to the attached drawings.

First Embodiment

Figure 2:
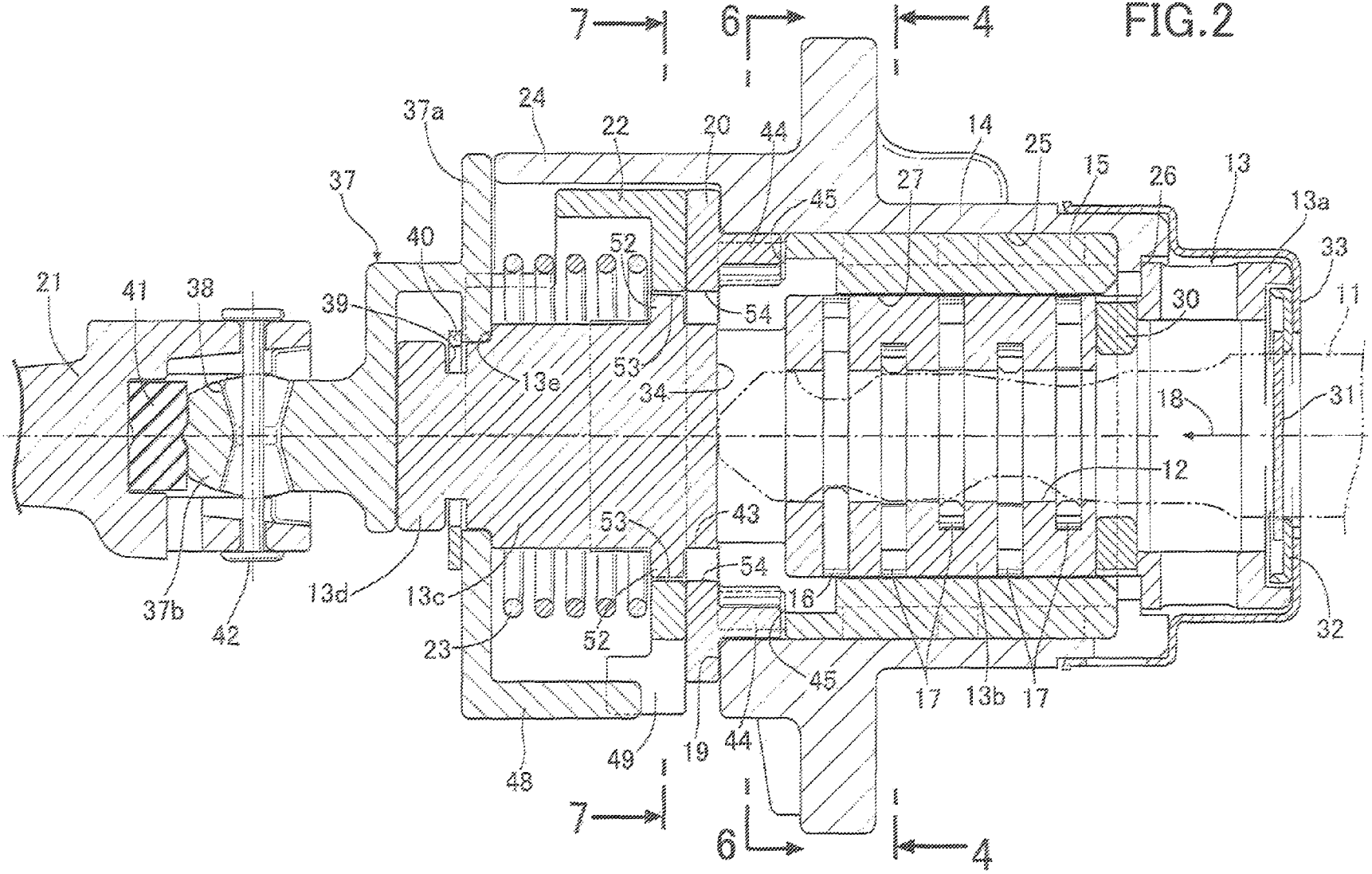
FIG. 2 is a vertical sectional view of the cylinder lock when viewed in the same direction as in FIG. 1. (first embodiment)
Figure 3:
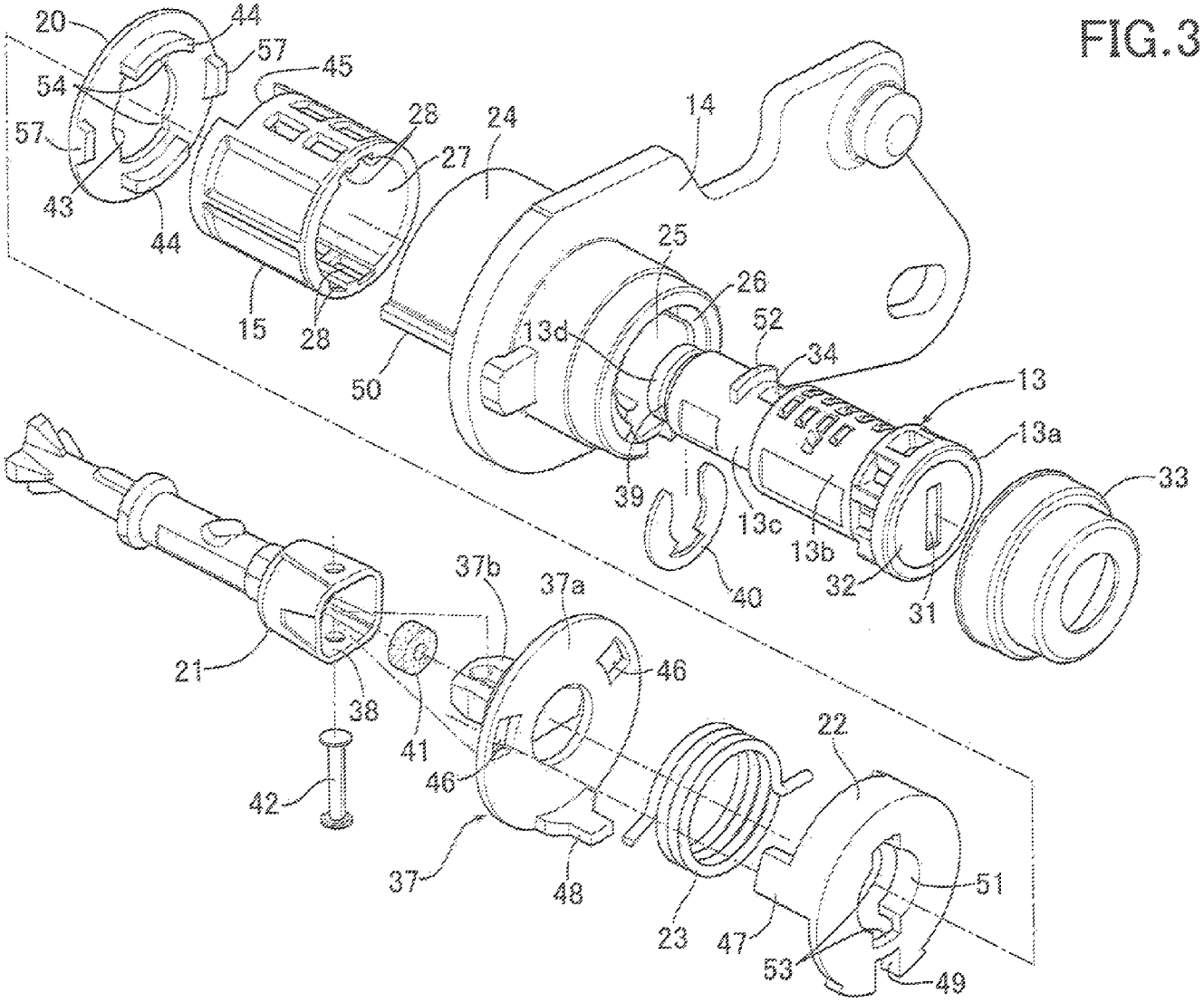
FIG. 3 is an exploded perspective view of the cylinder lock. (first embodiment)

First, in FIG. 1 to FIG. 3, this cylinder lock can switch a door locking mechanism provided on a door of a vehicle between a locked state and an unlocked state and includes an inner cylinder 13 having a key hole 12 into which a mechanical key 11 can be inserted, an outer cylinder 15 through which the inner cylinder 13 is relatively pivotably inserted and retained and that is pivotably retained on a fixed housing 14, a full tumbler 16 and half tumblers 17 that are retained on the inner cylinder 13 so as to be capable of switching between a state in which they can engage with the outer cylinder 15 and a state in which engagement with the outer cylinder 15 is released in response to insertion of the legitimate mechanical key 11 into the key hole 12, a first rotor 20 that is disposed so as to oppose a rotor-receiving part 19 provided on one of the housing 14 and the outer cylinder 15 (the housing 14 in this embodiment) so as to face forward along an insertion direction 18 of the mechanical key 11 into the key hole 12 and that is linked to the outer cylinder 15 so that it cannot pivot relative thereto but can move along the insertion direction 18, a second rotor 22 that abuts against the first rotor 20 from the side opposite to the rotor-receiving part 19 and that is linked relatively non-pivotably to a pivot member 21 linked to the door locking mechanism but movably along the insertion direction 18, and a torsion spring 23 as a resilient member exhibiting a resilient force for urging the first and second rotors 20 and 22, which abut against each other, toward the rotor-receiving part 19 side.

The housing 14 is fixed to the door and is integrally provided with the flat ring-shaped rotor-receiving part 19 facing forward along the insertion direction 18 of the mechanical key 11 into the key hole 12 and with a semi-circular cross section guide projection 24 projecting forward along the insertion direction 18 from the outer periphery of an upper half of the rotor-receiving part 19. A circular retaining hole 25 opening in a central part of the rotor-receiving part 19 is formed in the housing 14, and an inward collar 26 protruding in a radially inward direction from a rear end part of the retaining hole 25 along the insertion direction 18 is integrally provided with the housing 14.

The outer cylinder 15, which is provided with a cylinder hole 27, is pivotably inserted into the retaining hole 25 so as to have its rear end along the insertion direction 18 in sliding contact with the inward collar 26, and the front end of the outer cylinder 15 along the insertion direction 18 is disposed at a position that is flush with the rotor-receiving part 19.

The inner cylinder 13 is formed by coaxially and integrally connecting, in sequence from the rear end along the insertion direction 18, a large diameter portion 13*a* that has a larger diameter than that of the cylinder hole 27, a first medium diameter portion 13*b* that is formed with a smaller diameter than that of the large diameter portion 13*a* so as to be relatively pivotably inserted through the cylinder hole 27, a second medium diameter portion 13*c* that is formed with a smaller diameter than that of the first medium diameter portion 13*b*, and a small diameter portion 13*d* that is formed with a smaller diameter than that of the first medium diameter portion 13*b*.

The large diameter portion 13*a* of the inner cylinder 13 is disposed to the rear of the inward collar 26 of the housing 14 along the insertion direction 18, and this large diameter portion 13*a* abuts against the inward collar 26 so as to restrict forward movement of the inner cylinder 13 along the insertion direction 18.

The key hole 12 is formed in the large diameter portion 13*a* and the first medium diameter portion 13*b*, and with regard to the first medium diameter portion 13*b*, one full tumbler 16 and four pairs of half tumblers 17 are retained on the first medium diameter portion 13*b* at positions spaced in the axial direction of the key hole 12.

Figure 4:
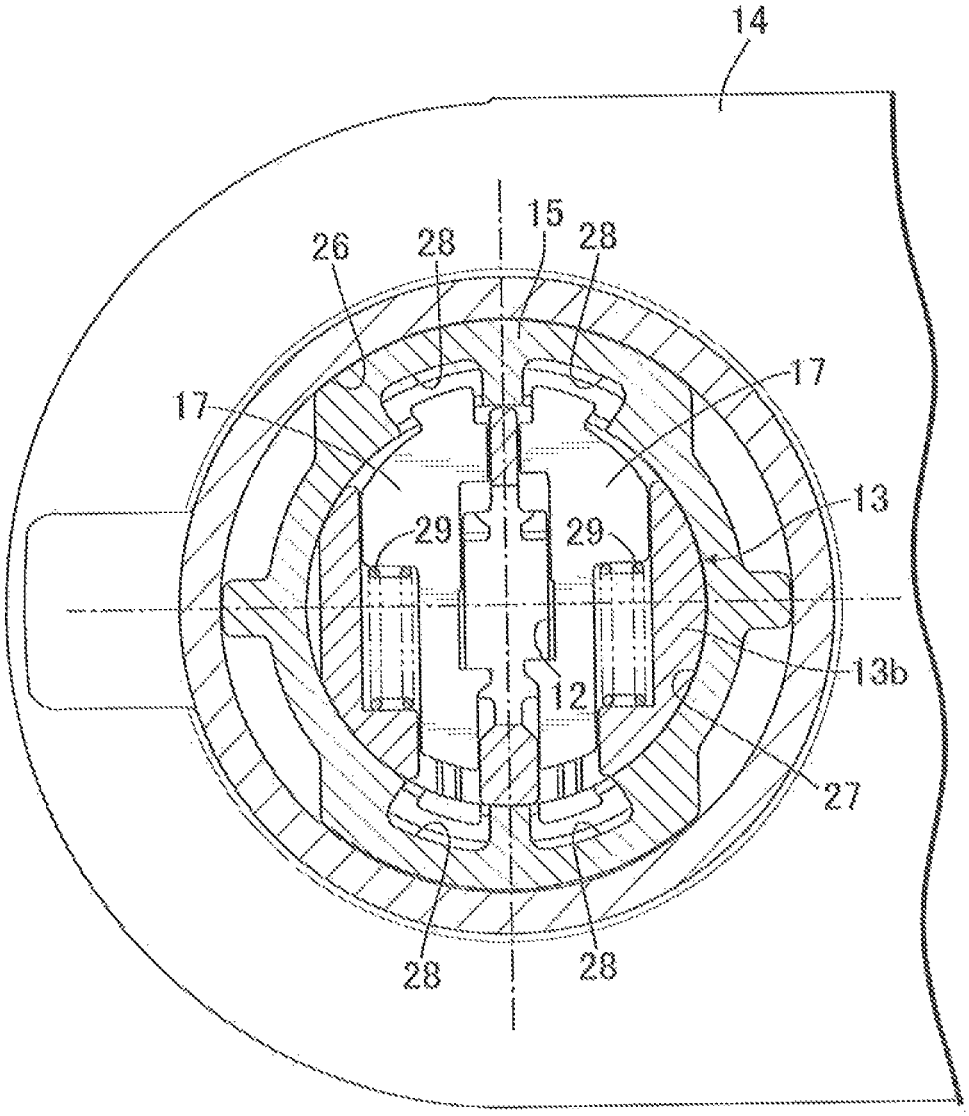
FIG. 4 is a sectional view along line 4-4 in FIG. 2 in a state in which a legitimate mechanical key is not inserted. (first embodiment)

In FIG. 4, two pairs of engagement grooves 28 and 28; 28 and 28 are provided on the inner periphery of the cylinder hole 27 of the outer cylinder 15 so as to extend in the axial direction, the half tumblers 17 are urged by means of springs 29 and 29 toward the side on which they engage with one of the two pairs of engagement grooves 28 and 28; 28 and 28, and the full tumbler 16 is also spring-biased toward the side on which it engages with the outer cylinder 15 in the same manner as for the half tumblers 17. Therefore, in a state in which the legitimate mechanical key 11 is not inserted into the key hole 12, the full tumbler 16 and the half tumblers 17 are engaged with the outer cylinder 15, and when the inner cylinder 13 is pivoted by an unauthorized operation the outer cylinder 15 also pivots. In contrast thereto, when the legitimate mechanical key 11 is inserted into the key hole 12, engagement of the full tumbler 16 and the half tumblers 17 with the outer cylinder 15 is released, and even when the inner cylinder 13 pivots the outer cylinder 15 remains stationary.

A protector 30 for suppressing as much as possible the entry of anything other than the mechanical key 11, such as a screwdriver, into the key hole 12 is disposed on an end part, on the large diameter portion 13*a* side, of the first medium diameter portion 13*b*, A support member 32 is mounted on the large diameter portion 13*a*, the support member 32 supporting a shutter plate 31 disposed at the rear end, along the insertion direction 18, of the key hole 12 so that it can open and close, and a cap 33 is mounted on the housing 14, the cap 33 covering the large diameter portion 13*a* together with the support member 32. Furthermore, a drain hole 34 communicating with the key hole 12 is formed in the rear end, along the insertion direction 18, of the second medium diameter portion 13*c* so as to extend vertically.

An inner joint 37 is retained on a front end part, along the insertion direction 18, of the inner cylinder 13, and this inner joint 37 integrally has a ring plate portion 37*a* that has an inner peripheral part abutting against an annular step portion 13*e* formed between the second medium diameter portion 13*c* and the small diameter portion 13*d* on the inner cylinder 13, and a linking projecting portion 37*b* that is inserted into a bottomed linking recess 38 provided in an end part on the inner joint 37 side of the pivot member 21.

A fitting groove 39 is provided on the outer periphery of the small diameter portion 13*d* of the inner cylinder 13, and the ring plate portion 37*a* of the inner joint 37 is retained between a retaining ring 40 fitted into the fitting groove 39 and the annular step portion 13*e*. Moreover, the front end of the guide projection 24 in the housing 14 and the annular step portion 13*e* of the inner cylinder 13 are disposed at the same position in the insertion direction 18, and the outer periphery of the ring plate portion 37*a* abuts against the front end of the guide projection 24, thus restricting rearward movement of the inner cylinder 13 along the insertion direction 18.

The linking projecting portion 37*b* of the inner joint 37 is inserted into the linking recess 38 with a resilient member 41 such as one made of rubber disposed between itself and the blocked end in the linking recess 38 of the pivot member 21, and is linked to the pivot member 21 by means of a pin 42.

Figure 5:
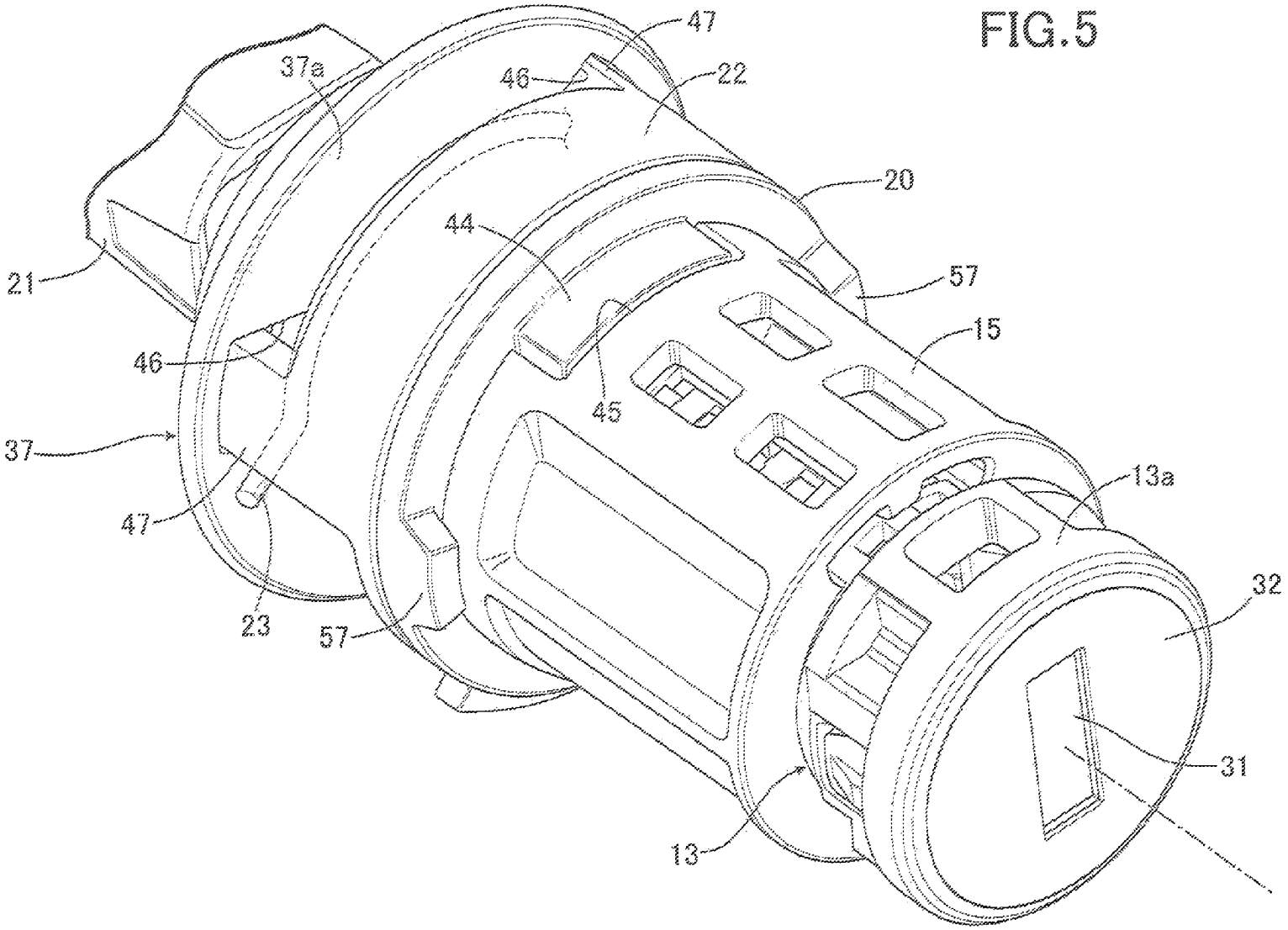
FIG. 5 is a perspective view in a state in which an inner cylinder, an outer cylinder, a first rotor, a second rotor, and an inner joint are assembled. (first embodiment)

Referring in addition to FIG. 5, the first rotor 20 is disposed so as to oppose the rotor-receiving part 19 of the outer cylinder 15, the first rotor 20 being capable of abutting against the rotor-receiving part 19 while having a first center hole 43 through which the second medium diameter portion 13*c* of the inner cylinder 13 is extended and being capable of making substantially half of its outer periphery be in sliding contact with the inner periphery of the guide projection 24 in the housing 14.

Figure 6:
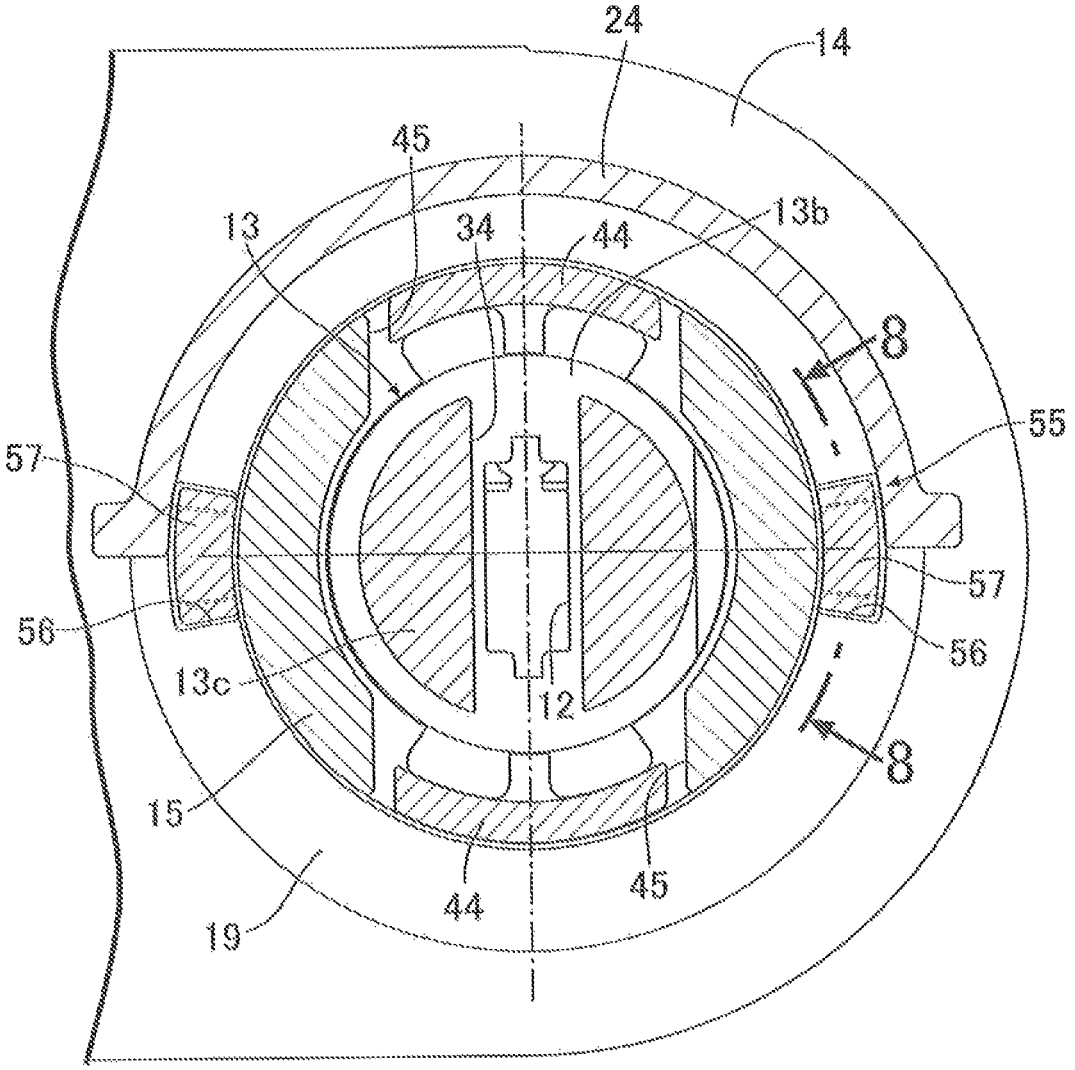
FIG. 6 is a sectional view along line 6-6 in FIG. 2. (first embodiment)

Referring in addition to FIG. 6, a pair of arc-shaped fitting projections 44 and 44 disposed at symmetrical positions with respect to the central axis of the first center hole 43 are integrally and projectingly provided on an outer peripheral part of the first rotor 20 so as to be inserted into the retaining hole 25 of the housing 14, and cutouts 45 and 45 are provided in a front end part along the insertion direction 18 of the outer cylinder 15, the pair of fitting projections 44 and 44 being fitted into the cutouts 45 and 45. Because of this, the first rotor 20 is linked to the outer cylinder 15 so that it cannot pivot relative to the outer cylinder 15 but can move along the insertion direction 18.

The second rotor 22, which abuts against the first rotor 20 from the side opposite to the rotor-receiving part 19, is provided integrally with a pair of linking arm parts 47 and 47 that are inserted through a pair of linking holes 46 and 46 provided in the ring plate portion 37*a* of the inner joint 37, and a fitting recess 49 is formed on the outer periphery of the second rotor 22, a linking arm part 48 provided integrally with the ring plate portion 37*a* being fitted into the fitting recess 49. Therefore, since the second rotor 22 is linked to the inner joint 37 relatively movably along the insertion direction 18 but relatively non-pivotably, and the inner joint 37 is relatively non-pivotably linked to the pivot member 21, the second rotor 22 is linked to the pivot member 21 movably along the insertion direction 18 but relatively non-pivotably.

The torsion spring 23 is disposed between the second rotor 22 and the inner joint 37 so as to surround the second medium diameter portion 13*c* of the inner cylinder 13. Opposite end parts of the torsion spring 23 are engaged with the pair of linking arm parts 47 of the second rotor 22 and also engaged with latching projections 50 provided on opposite end parts in the peripheral direction of the guide projection 24, which is integral with the housing 14. The torsion spring 23 thereby urges the first and second rotors 20 and 22, which abut against each other, toward the rotor-receiving part 19 side of the outer cylinder 15 and pivotingly urges the second rotor 22 toward the side that makes it return to a neutral position even when the second rotor 22 pivots in either direction from the neutral position.

Figure 7:
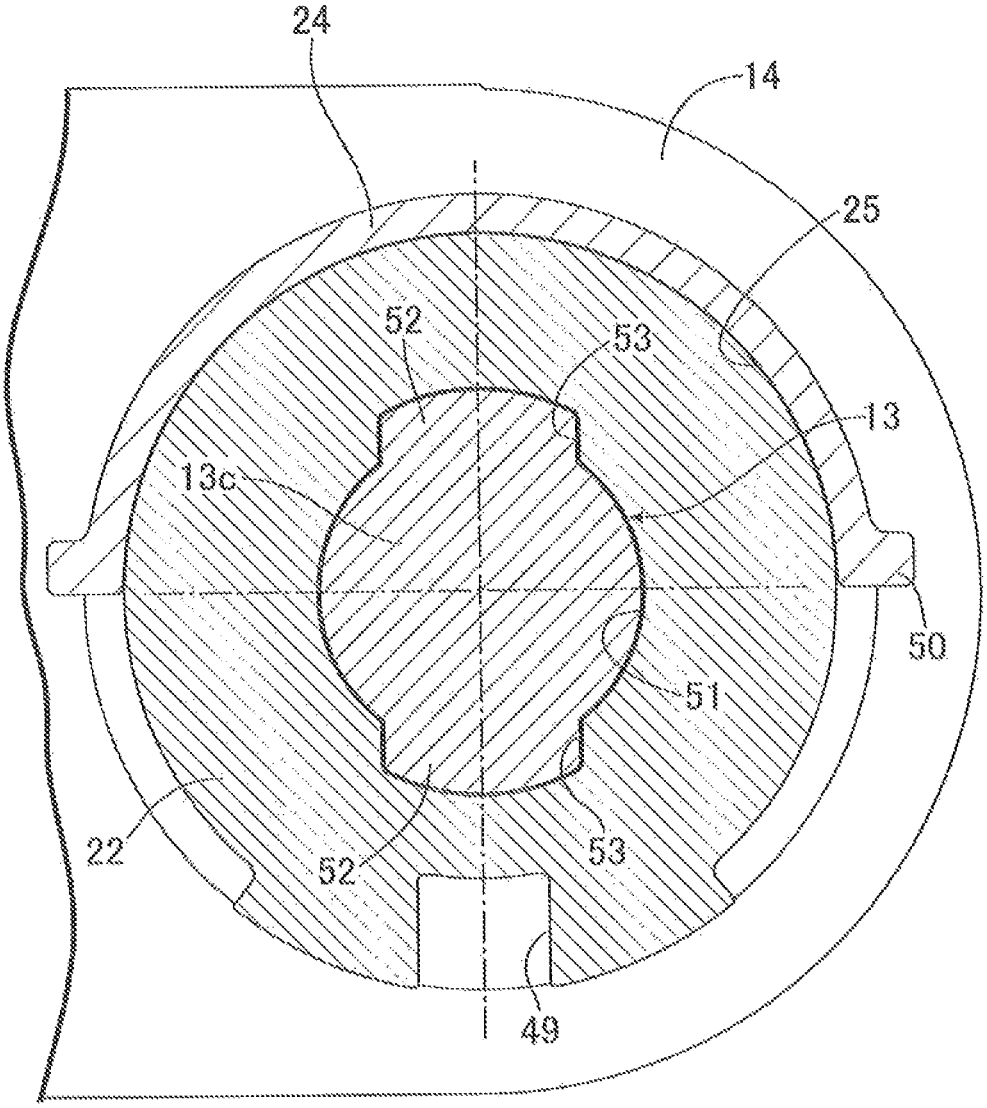
FIG. 7 is a sectional view along line 7-7 in FIG. 2. (first embodiment)

Referring in addition to FIG. 7, the second rotor 22 has a second center hole 51 through which the second medium diameter portion 13*c* of the inner cylinder 13 extends, and a pair of latching recesses 53 and 53 are formed on the inner periphery of the second center hole 51, a pair of engagement parts 52 and 52 being capable of engaging with the pair of latching recesses 53 and 53 in a state in which the second rotor 22 is at a retracted position and is abutting against the first rotor 20, which is abutting against the rotor-receiving part 19, and the pair of engagement parts 52 and 52 being projectingly provided on the second medium diameter portion 13*c* of the inner cylinder 13 so as to be disposed on one diameter of the second medium diameter portion 13*c*.

Moreover, a pair of latching recesses 54 and 54, with which the engagement parts 52 and 52 of the inner cylinder 13 can engage, are formed on the inner periphery of the first center hole 43 of the first rotor 20. The engagement parts 52 and 52 of the inner cylinder 13 do not engage with the latching recesses 54 and 54 of the first rotor 20 at the retracted position where it abuts against the rotor-receiving part 19, but the engagement parts 52 and 52 of the inner cylinder 13 engage with the latching recesses 54 and 54 of the first rotor 20 at a forward position where it is detached from the rotor-receiving part 19, and in this arrangement the engagement parts 52 and 52 are in a state in which they are disengaged from the latching recesses 53 and 53 of the second rotor 22.

Figure 8:
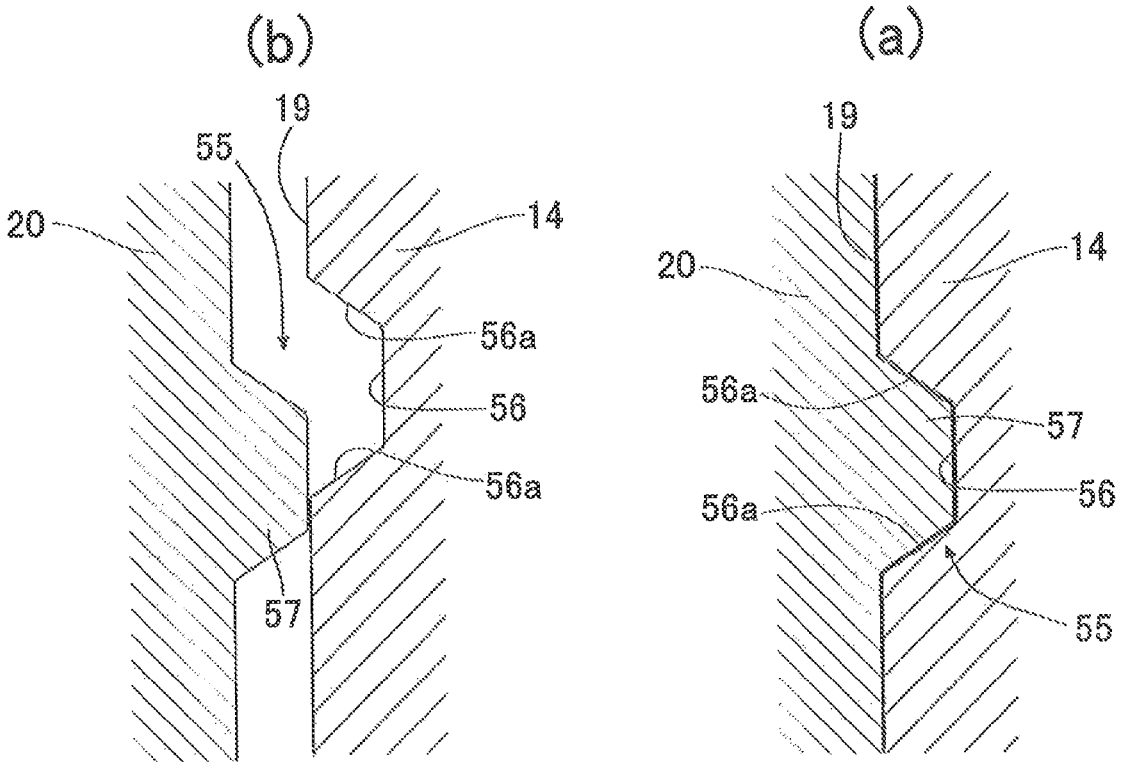
FIG. 8 is a sectional view along line 8-8 in FIG. 6. (first embodiment)

Referring in addition to FIG. 6 and FIG. 8, a cam mechanism 55 is provided between the housing 14 and the first rotor 20, the cam mechanism 55 moving the first rotor 20 in response to pivoting of the first rotor 20 accompanying pivoting of the outer cylinder 15 to the forward position where it is detached from the rotor-receiving part 19, against the spring force of the torsion spring 23.

This cam mechanism 55 is formed from a pair of recesses 56 and 56 provided in the rotor-receiving part 19 of the housing 14 so as to be disposed on one diameter thereof, and a pair of projections 57 and 57 projectingly provided on the first rotor 20 so as to be fitted into the recesses 56 and 56, the recess 56 is formed so as to have inclined cam faces 56*a* and 56*a* at opposite ends in the peripheral direction, and the projection 57 is formed into a trapezoidal shape corresponding to the recess 56. Moreover, the recesses 56 and 56 are formed in the housing 14 so as to be disposed at a position where the projections 57 and 57 fit into them when the first rotor 20 is at the neutral position in the pivoting direction.

Figure 9:
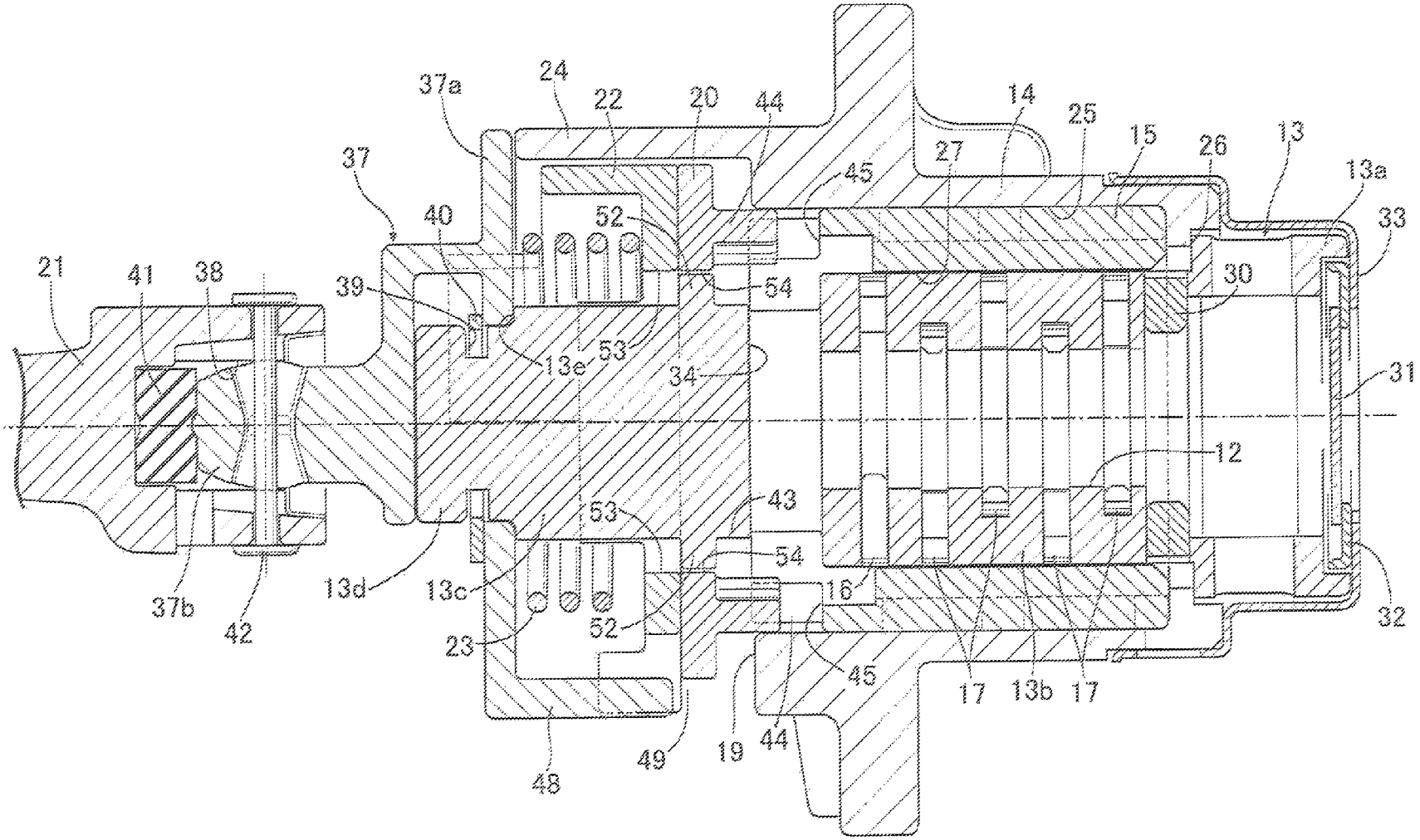
FIG. 9 is a vertical sectional view, corresponding to FIG. 2, of the cylinder lock in a state in which there has been an unauthorized operation. (first embodiment)

In accordance with such a cam mechanism 55, in a state in which the outer cylinder 15 is not pivoted in a state in which an unauthorized operation is not carried out, the first rotor 20 at the neutral position in the pivoting direction and in a state in which it is urged toward the rotor-receiving part 19 side by the spring force of the torsion spring 23 is at the retracted position where it abuts against the rotor-receiving part 19 with the projections 57 fitted into the recesses 56 as shown in FIG. 8 (*a*), whereas when the outer cylinder 15 is pivoted together with the inner cylinder 13 by means of an unauthorized operation, the first rotor 20, which is linked to the outer cylinder 15 relatively non-pivotably but movably along the insertion direction 18, pivots from the neutral position together with the outer cylinder 15, and as shown in FIG. 8 (*b*) the projections 57 are guided by the cam faces 56*a* of the recesses 56, the first rotor 20 thereby moving forward from the rotor-receiving part 19 and moving to the forward position. When the first rotor 20 moves forward in this way, as shown in FIG. 9 the engagement parts 52 and 52 of the inner cylinder 13 engage with the latching recesses 54 and 54 of the first rotor 20, the inner cylinder 13 is thereby relatively non-pivotably engaged with the first rotor 20, and the second rotor 22, whose engagement with the inner cylinder 13 is released, is pivoted toward the neutral position side by means of the spring force of the torsion spring 23.

The operation of this embodiment is now explained. The inner cylinder 13 having the key hole 12 is relatively pivotably inserted through and retained by the outer cylinder 15, which is pivotably retained by the fixed housing 14. The full tumbler 16 and the half tumblers 17, which can switch between a state in which they engage with the outer cylinder 15 and a state in which engagement with the outer cylinder 15 is released in response to insertion of the legitimate mechanical key 11 into the key hole 12, are retained on the inner cylinder 13. The first rotor 20, which is disposed so as to oppose the rotor-receiving part 19 provided on the housing 14 so as to face forward in the insertion direction 18 of the mechanical key 11 into the key hole 12, is linked to the outer cylinder 15 relatively non-pivotably but movably along the insertion direction 18. The second rotor 22 abutting against the first rotor 20 from the side opposite to the rotor-receiving part 19 is linked to the pivot member 21 relatively non-pivotably but movably along the insertion direction 18. The first and second rotors 22 abutting against each other are urged toward the rotor-receiving part 19 side by means of the torsion spring 23. The cam mechanism 55 is provided between the housing 14 and the first rotor 20, the cam mechanism 55 moving the first rotor 20 toward the side on which it becomes detached from the rotor-receiving part 19 against the spring force of the torsion spring 23 in response to pivoting of the first rotor 20 accompanying pivoting of the outer cylinder 15. The inner cylinder 13 is provided with the engagement parts 52 and 52, which relatively non-pivotably engage with the second rotor 22 in a state in which the second rotor 22, from the side opposite to the rotor-receiving part 19, abuts against the first rotor 20 abutting against the rotor-receiving part 19, but whose engagement with the second rotor 22 is released in a state in which the first and second rotors 20 and 22 are detached from the rotor-receiving part 19 by virtue of the operation of the cam mechanism 55.

Therefore, if anything other than the legitimate mechanical key 11, such as a screwdriver, is inserted into the key hole 12 of the inner cylinder 13 and an unauthorized pivoting operation is carried out, since the full tumbler 16 and the half tumblers 17 are engaged, the outer cylinder 15 pivots together with the inner cylinder 13, and due to the function of the cam mechanism 55 between the first rotor 20 and the housing 14 the first and second rotors 20 and 22 move so as to become detached from the rotor-receiving part 19 of the outer cylinder 15. As a result, engagement of the engagement parts 52 and 52 of the inner cylinder 13 with the second rotor 22 is released; even if the inner cylinder 13 pivots the second rotor 22 will not pivot, and the pivot member 21 is not therefore pivoted, thereby enabling theft resistance to be obtained. Moreover, a theft resistant cylinder lock can be obtained by a simple and small-sized structure having a smaller number of components, which is a simple structure in which the first rotor 20 is disposed between the second rotor 22 and the outer cylinder 15 and the cam mechanism 55 is provided between the first rotor 20 and the housing 14.

Furthermore, since the engagement parts 52 and 52 provided on the inner cylinder 13 are relatively non-pivotably engaged with the first rotor 20 in a state in which it is detached from the rotor-receiving part 19, even if the inner cylinder 13 is pivoted to a position that is different from a usual position by means of an unauthorized operation and is left there while engagement with the second rotor 22 is released, when the legitimate mechanical key 11 is inserted into the key hole 12 and pivotingly operated, the first rotor 20 also pivots; when the first rotor 20 pivots to the neutral position together with the outer cylinder 15, the first rotor 20 urged by means of the torsion spring 23 moves to the side on which it abuts against the rotor-receiving part 19 of the outer cylinder 15 by virtue of the operation of the cam mechanism 55, and the second rotor 22, which has been at the neutral position up until then, moves accompanying it, thereby recovering engagement of the engagement parts 52 and 52 of the inner cylinder 13 with the second rotor 22. Therefore, as a result of a pivoting operation by the legitimate mechanical key 11 inserted into the key hole 12, the second rotor 22 pivots together with the inner cylinder 13, thus enabling the pivot member 21 to be pivoted.

An embodiment of the present invention is explained above, but the present invention is not limited to the embodiment above and may be modified in a variety of ways as long as the modifications do not depart from the spirit and scope thereof.

For example, in the embodiment above a case in which the pivot member is linked to the door locking mechanism provided on the door of a vehicle is explained, but it may be linked to a locking mechanism other than the above, and the pivot member may be operatively linked to a main switch of a vehicle.

The invention claimed is:

1. A cylinder lock in which a pivot member is pivoted in response to pivoting by a legitimate mechanical key inserted into a key hole, wherein the cylinder lock comprises an inner cylinder that has the key hole, an outer cylinder that has the inner cylinder relatively pivotably inserted therethrough and retained and that is pivotably retained on a fixed housing, a plurality of tumblers that are retained on the inner cylinder so as to be capable of switching between a state in which the tumblers engage with the outer cylinder and a state in which engagement with the outer cylinder is released in response to the legitimate mechanical key being inserted into the key hole, a first rotor that is disposed so as to oppose a rotor-receiving part provided on one of the housing and the outer cylinder so as to face forward along an insertion direction of the mechanical key into the key hole and that is linked to the outer cylinder relatively non-pivotably but movably along the insertion direction, a second rotor that abuts against the first rotor from a side opposite to the rotor-receiving part and that is linked to the pivot member relatively non-pivotably but movably along the insertion direction, a resilient member that exhibits a resilient force for urging the first and second rotors, abutting against each other, toward the rotor-receiving part side, and a cam mechanism that is provided between the housing and the first rotor so as to move the first rotor against the resilient force of the resilient member, in response to pivoting of the first rotor accompanying pivoting of the outer cylinder, toward a side on which the first rotor becomes detached from the rotor-receiving part, the inner cylinder being provided with an engagement part that relatively non-pivotably engages with the second rotor in a state in which the second rotor abuts against the first rotor, abutting against the rotor-receiving part, from the side opposite to the rotor-receiving part and that releases engagement with the second rotor in a state in which the first and second rotors are detached from the rotor-receiving part due to operation of the cam mechanism, and the engagement part relatively non-pivotably engages with the first rotor in a state in which the first and second rotors are detached from the rotor-receiving part due to the operation of the cam mechanism.

* * * * *